US008620172B2

(12) United States Patent
Yoshizumi

(10) Patent No.: US 8,620,172 B2
(45) Date of Patent: Dec. 31, 2013

(54) IMAGE FORMING APPARATUS, METHOD AND STORAGE MEDIUM FOR SETTING FUSING TEMPERATURE

(75) Inventor: Takeshi Yoshizumi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 293 days.

(21) Appl. No.: 13/067,525

(22) Filed: Jun. 7, 2011

(65) Prior Publication Data

US 2011/0318038 A1 Dec. 29, 2011

(30) Foreign Application Priority Data

Jun. 25, 2010 (JP) ..... 2010-144959

(51) Int. Cl.
*G03G 15/20* (2006.01)

(52) U.S. Cl.
USPC ..... 399/69

(58) Field of Classification Search
USPC ..... 399/69, 70, 321, 328, 330; 219/216; 358/1.13
See application file for complete search history.

(56) References Cited

U.S. PATENT DOCUMENTS

| | | | | |
|---|---|---|---|---|
| 5,918,087 | A | 6/1999 | Kimura et al. | |
| 6,538,453 | B1 * | 3/2003 | Orchard et al. | 324/549 |
| 7,365,865 | B2 * | 4/2008 | Kidani et al. | 358/1.13 |
| 7,560,665 | B2 * | 7/2009 | Hamilton et al. | 219/216 |
| 2004/0109702 | A1 | 6/2004 | Shimura et al. | |
| 2005/0191063 | A1 | 9/2005 | Ichikawa et al. | |
| 2009/0103148 | A1 | 4/2009 | Murakami | |
| 2009/0103934 | A1 | 4/2009 | Murakami | |
| 2009/0297199 | A1 | 12/2009 | Yamashina et al. | |
| 2010/0239300 | A1 * | 9/2010 | Sato | 399/69 |
| 2011/0020021 | A1 | 1/2011 | Murakami | |

FOREIGN PATENT DOCUMENTS

| | | | |
|---|---|---|---|
| CN | 101419414 | | 4/2009 |
| EP | 2 131 253 | | 12/2009 |
| JP | 60-263173 | | 12/1985 |
| JP | 06149122 | A * | 5/1994 |
| JP | 11161090 | A * | 6/1999 |
| JP | 2003-015461 | A | 1/2003 |
| JP | 2004-151626 | | 5/2004 |
| JP | 2006-260185 | A | 9/2006 |
| JP | 2008-015320 | | 1/2008 |
| JP | 2009237183 | A * | 10/2009 |

OTHER PUBLICATIONS

European Search Report dated Nov. 16, 2011.

* cited by examiner

*Primary Examiner* — Robert Beatty
(74) *Attorney, Agent, or Firm* — Harness, Dickey & Pierce, P.L.C.

(57) ABSTRACT

An image forming apparatus for outputting a printed product includes a fusing unit, an image forming control unit to receive print data and print attribution information for printing the printed product; and a print engine including a fusing controller to control a fusing temperature of the fusing unit. The print engine outputs the printed product using a fusing temperature designated by the print attribution information. The fusing controller determines a target fusing temperature for the fusing unit by comparing a first fusing temperature and a second fusing temperature. The first fusing temperature is used for a most recently conducted fusing process. The second fusing temperature is designated by the print attribution information. The fusing controller determines the target fusing temperature to the first fusing temperature or the second fusing temperature depending on the number of colors required for printing the printed product.

10 Claims, 9 Drawing Sheets

FIG. 7

700

| 702 IMAGE COLOR INFORMATION | 704 FUSING TEMPERATURE VALUE | 706 Tp FLAG |
|---|---|---|
| color | Tc | 1 |
| monochrome | Tm | 0 |

TOGGLE FLAG

710

| 712 IMAGE COLOR INFORMATION | 714 FUSING TEMPERATURE VALUE | | |
|---|---|---|---|
| | paper 1 | paper 2 | paper 3 |
| color | Tc | Tc2 | Tc3 |
| monochrome | Tm | Tm2 | Tm3 |
| ... | ... | ... | ... |

720

| | | |
|---|---|---|
| 1 | 0 | 0 |
| 0 | 0 | 0 |
| 0 | 0 | 0 |

730

| 732 PRINTER CONTROL COMMAND | 734 FUSING TEMPERATURE VALUE |
|---|---|
| high_fix_temp | Tc |
| low_fix_temp | Tm |

IMAGE FORMING APPARATUS, METHOD AND STORAGE MEDIUM FOR SETTING FUSING TEMPERATURE

CROSS-REFERENCE TO RELATED APPLICATIONS

This application claims priority to Japanese Patent Application No. 2010-144959, filed on Jun. 25, 2010 in the Japan Patent Office, which is incorporated by reference herein in its entirety.

BACKGROUND OF THE INVENTION

1. Field of the Invention

The present invention relates to an image forming apparatus, and to an image forming method employing a fusing process in view of energy-efficient use in response to print attribution information of to-be-formed images.

2. Description of the Background Art

Image forming apparatuses using electrophotography have been used as various machines such as copiers, laser printers, multi-functional apparatuses known as multi-functional peripherals (MFP), production printing machines, or the like. Colored micro-particles such as toner particles are used as a development agent for the electrophotography, and the toner is fused and fixed on a sheet of recording media such as a sheet of paper by applying heat and pressure, by which durable printed products can be produced.

In the electrophotography process, a fusing member is heated by a fusing heater to obtain a temperature required for a heat-applying fusing process, in which the fusing heater needs more electric power for the fusing process. In view of the desirability of energy savings and/or lower carbon emissions, it is preferable to reduce electric power consumption of the fusing heater. The amount of electric power required for the heat-applying fusing process using toner is mainly determined by the fusing temperature, and the fusing temperature in turn is determined by such factors such as the type of sheets, heat property of toner, or the like. Therefore, electric power consumption can be reduced by decreasing the fusing temperature.

Fusing technologies for electrophotography have been developed. For example, JP-2006-260185-A discloses a method of predicting a time for an image drawing process executed by an image analyzing unit based on the print contents and adjusting the timing of the issuance of an engine activation command for fusing.

In the method disclosed in JP-2006-260185-A, an activation command is issued to the print engine, but a time to start a printing operation is delayed when the image processing step takes a longer time. In such a situation, the print engine may be instructed not to return to the energy saving mode. With such a configuration, the activated print engine may not be set to the deactivated condition, by which electric power consumption can be reduced because an unnecessary power-down condition can be prevented. Further, in the method disclosed JP-2003-15461-A, to save energy, the fusing temperature is varied depending on the toner used for printing.

However, JP-2006-260185-A is focused on the activation timing of print engine and does not consider a process control in view of toner properties, contents of to-be-printed image, or the like. As a result, energy saving setting in view of to-be-formed images and/or the types of sheet may not be conducted.

Further, in JP-2003-15461-A, when the image forming apparatus returns from the energy saving mode to the print mode in which a printing operation can be conducted, the fusing temperature may be increased to a temperature required for full-color printing using all color toners. When monochrome printing is conducted using such image forming apparatus, the monochrome printing may be conducted using a higher fusing temperature, which may be too high for the monochrome printing.

As such, in the conventional art, when the image forming apparatus returns from the energy saving mode to the print mode, the fusing temperature may be increased to a too-high temperature for some image forming operations normally conducted in offices and/or homes.

SUMMARY

In one aspect of the present invention, an image forming apparatus for receiving print data from an information processing apparatus and outputting the print data as a printed product on a recording medium is devised. The image forming apparatus includes a fusing unit; an image forming control unit to receive the print data and corresponding print attribution information to prepare page data for printing the printed product, with the image forming apparatus shifted from an energy saving mode to a print mode; and a print engine that includes a fusing controller having a fusing temperature setting unit to control a fusing temperature of the fusing unit. The print engine obtains the page data and the corresponding print attribution information from the image forming control unit. The print engine outputs the printed product using a fusing temperature designated by the print attribution information. When the image forming apparatus returns from the energy saving mode to the print mode, the fusing controller determines a target fusing temperature for the fusing unit by comparing a first fusing temperature and a second fusing temperature. The first fusing temperature is used for a most recent fusing process conducted before the image forming apparatus last shifted to the energy saving mode. The second fusing temperature is designated by the print attribution information. The fusing controller determines the target fusing temperature using the first fusing temperature or the second fusing temperature depending on the number of colors required for printing the printed product.

In another aspect of the present invention, an image forming method for outputting print data, received from an information processing apparatus, as a printed product on a recording medium using a fusing unit of an image forming apparatus, is devised. The method includes the steps of: receiving the print data and corresponding print attribution information to prepare page data for printing the printed product; comparing a first fusing temperature and a second fusing temperature, the first fusing temperature being used for a most recent fusing process conducted before the image forming apparatus last shifted to the energy saving mode, the second fusing temperature being designated by the print attribution information; determining a target fusing temperature of the fusing unit based on a result of the comparing step, in which, when the image forming apparatus returns from the energy saving mode to the print mode, the target fusing temperature is determined using the first fusing temperature or the second fusing temperature depending on the number of colors required for printing the printed product; and fusing the printed product using the target fusing temperature set at the controlling step.

In another aspect of the present invention, a computer-readable medium storing a program is devised. The program includes instructions that when executed by a computer cause the computer to execute an image forming method for outputting print data, received from an information processing apparatus, as a printed product on a recording medium using a fusing unit of an image forming apparatus by executing the program with the computer. The method includes the steps of: receiving the print data and corresponding print attribution information to prepare page data for printing the printed product; comparing a first fusing temperature and a second fusing temperature, the first fusing temperature being used for a most recent fusing process conducted before the image forming apparatus last shifted to the energy saving mode, the second fusing temperature being designated by the print attribution information; determining a target fusing temperature of the fusing unit based on a result of the comparing step, in which, when the image forming apparatus returns from the energy saving mode to the print mode, the target fusing temperature is determined using the first fusing temperature or the second fusing temperature depending on the number of colors required for printing the printed product; and fusing the printed product using the target fusing temperature set at the controlling step.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 7 shows examples of lookup table (LUT) stored in a memory and useable by then image analyzing unit and fusing controller according to an example embodiment;

Figure 1:
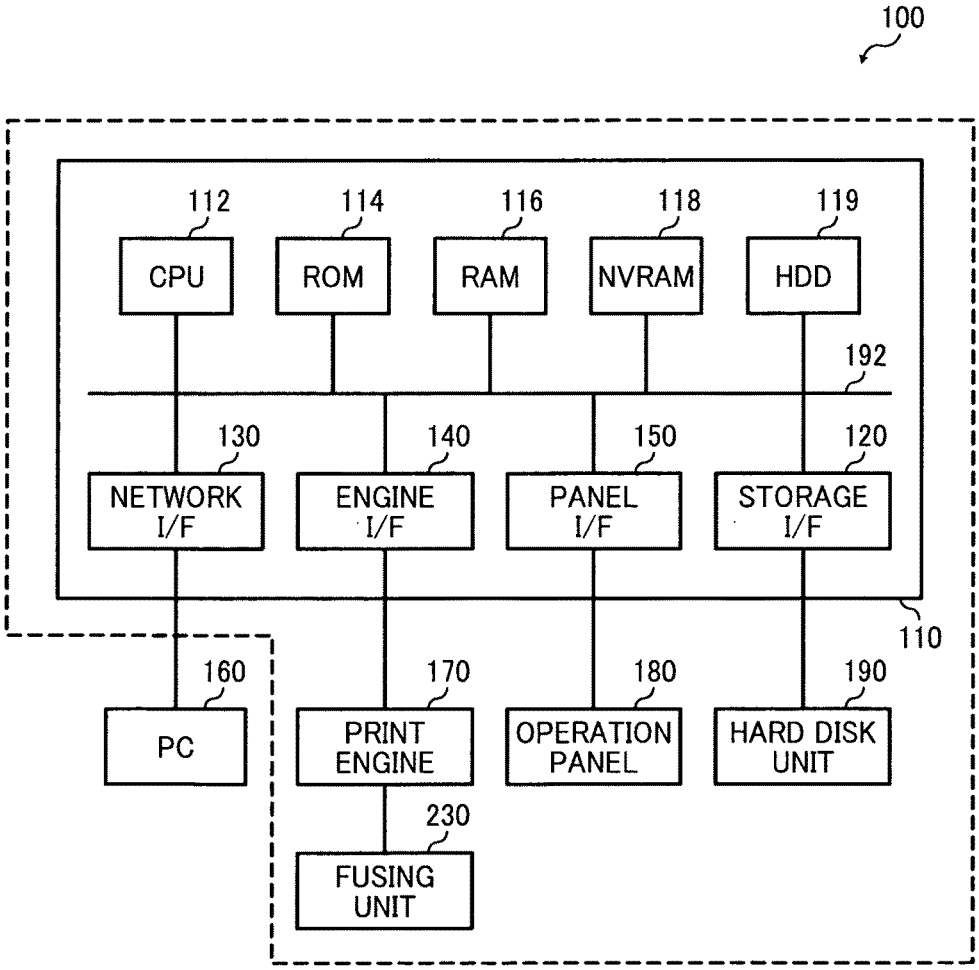
FIG. 1 shows a block diagram of hardware configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, an image forming apparatus according to example embodiment is described hereinafter.

FIG. 1 shows a block diagram of hardware configuration of an image forming apparatus 100 according to an example embodiment. As shown in FIG. 1, the image forming apparatus 100 may include units, encircled by a dotted line, such as for example an image forming control unit 110, a print engine 170, an operation panel 180, a hard disk unit 190, and a fusing unit 230. In this disclosure, fusing and fixing may be used with a same meaning.

Further, the image forming control unit 110 may be connectable to a computer such as a personal computer, a work station or the like (hereinafter, referred to as PC) via a network. For example, the image forming control unit 110*a* may receive electronic data from a personal computer (PC) 160 prepared by a user, then conducts various processing, and, for example, transmits print data to the print engine 170 to instruct image forming operations. The print engine 170 receives the print data from the image forming control unit 110, and outputs a printed product corresponding to the electronic data such as print data.

Specifically, the image forming apparatus 100 may include a central processing unit (CPU) 112, a read only memory (ROM) 114, a random access memory (RAM) 116, a non-volatile random access memory (NVRAM) 118, and a hard disk drive (HDD) 119. The CPU 112 may be, for example, an application specific integrated circuit (ASIC), which can conduct image forming operations for the image forming apparatus 100. For example, the CPU 112 reads out control programs and data stored in the ROM 114 to conduct various processing for preparing print data to be printed by the print engine 170.

The RAM 116 provides a run time execution space to enable the CPU 112 to execute various processing. For example, the CPU 112 can write run time data and/or variables, generated by executing programs, to the RAM 116, and retrieve the run time data and/or variables from the RAM 116 to conduct processing for the image forming apparatus 100. Further, the NVRAM 118 may be a non-volatile memory to store data such as run time data and/or variables required for controlling image forming operations of the image forming apparatus 100.

The image forming apparatus 100 may further include a network interface (I/F) 130, an engine interface (I/F) 140, a panel interface (I/F) 150, and a storage interface (I/F) 120. The network I/F 130 provides a function of physical layer and network layer to connect with a network such as a local area network (LAN). For example, the network I/F 130 enables data transmission between the PC 160 and image forming control unit 110 using a transaction protocol such as transmission control protocol/internet protocol (TCP/IP), user datagram protocol/internet protocol (UDP/IP), or the like, in which electronic data can be transmitted using protocol such as for example Ethernet (registered trademark), file transfer protocol (FTP), or the like.

The engine I/F 140 transmits print data, prepared from the electronic data by using the image forming control unit 110, to the print engine 170. For example, the engine I/F 140 may be a bus interface such as peripheral component interconnects (PCI), Compact PCI, PCI Express, universal serial bus (USB), the interface of the Institute of Electrical and Electronics Engineers (IEEE) 1396, and other suitable interfaces.

The panel I/F 150 receives control signals from the operation panel 180 to be used to set various settings for the image forming control unit 110, and decodes the control signals to given codes that can be interpreted by the image forming control unit 110. Further, the panel I/F 150 enables an user-input to the CPU 112 via the operation panel 180, and an output of result processed by the CPU 112 to the operation panel 180.

Further, the operation panel 180 may be an input/output unit having a display such as a cathode ray tube (CRT), a liquid crystal display (LCD), a plasma display (PD), and a keyboard, a mouse or the like, but not limited thereto.

The above described each of the functional units may be connected each other via an internal bus 192 such as a system bus and an input/output bus to function as the image forming control unit 110 as a whole.

The storage I/F 120 may be an interface for data transmission with an external storage unit such as for example the hard disk unit 190 having a greater storage capacity, a USB memory, or the like, and the storage I/F 120 may be an interface using given protocols such as Ultra AT Attachment (ULTRAATA), Serial ATA (SERIALATA), USB 2.0 or the like.

The PC 160 may transmit electronic data to the image forming apparatus 100, and the print engine 170 outputs a printed product corresponding to the electronic data. The PC 160 may include a CPU, a RAM, a ROM, a hard disk unit, or the like, and runs applications such as word processor, a graphics mode, a drawing mode, computer assisted design (CAD) under a given operating system (OS) to prepare document and/or data. When the PC 160 requests a printing operation to the image forming apparatus 100, the PC 160 may display a print wizard, provided by a printer driver, on a screen of the PC 160 such as desktop screen. A user can set various settings from the print wizard. When the user operates a mouse to press an "OK" button such as "OK" icon after completing settings, the printer driver starts processing for conducting a print operation of electronic data, which may be referred to as a mouse-initiating event. The electronic data may be prepared as the print data by conducting rasterizing, spooling, and so on to the electronic data, and the print data can be transmitted to the image forming apparatus 100.

The printer driver may conduct several processes such as adding page description language (PDL) to electronic data, rasterizing and spooling for image data, and transmission of print data to the image forming apparatus 100 having a network address. In an example embodiment, a control signal used for controlling a fusing temperature may be set by a user using a graphical user interface (GUI) provided by the printer driver, and the control signal can be added to the print data. Such control signal may be hereinafter referred to as "image color information," which may indicate color information to be used for printing operation wherein the image color may be one color, two colors, three colors, and so on.

Upon receiving the print data, the image forming apparatus 100 interprets the PDL and prepares page data with a data format that can be printed by the image forming apparatus 100, and starts a printing operation. In an example embodiment, upon receiving the print data, the image forming apparatus 100 extracts the image color information from the print data, and transmits the image color information to the print engine 170 while the image forming apparatus 100 prepares page data, and a fusing temperature control can be initiated or activated based on the image color information.

Figure 2:
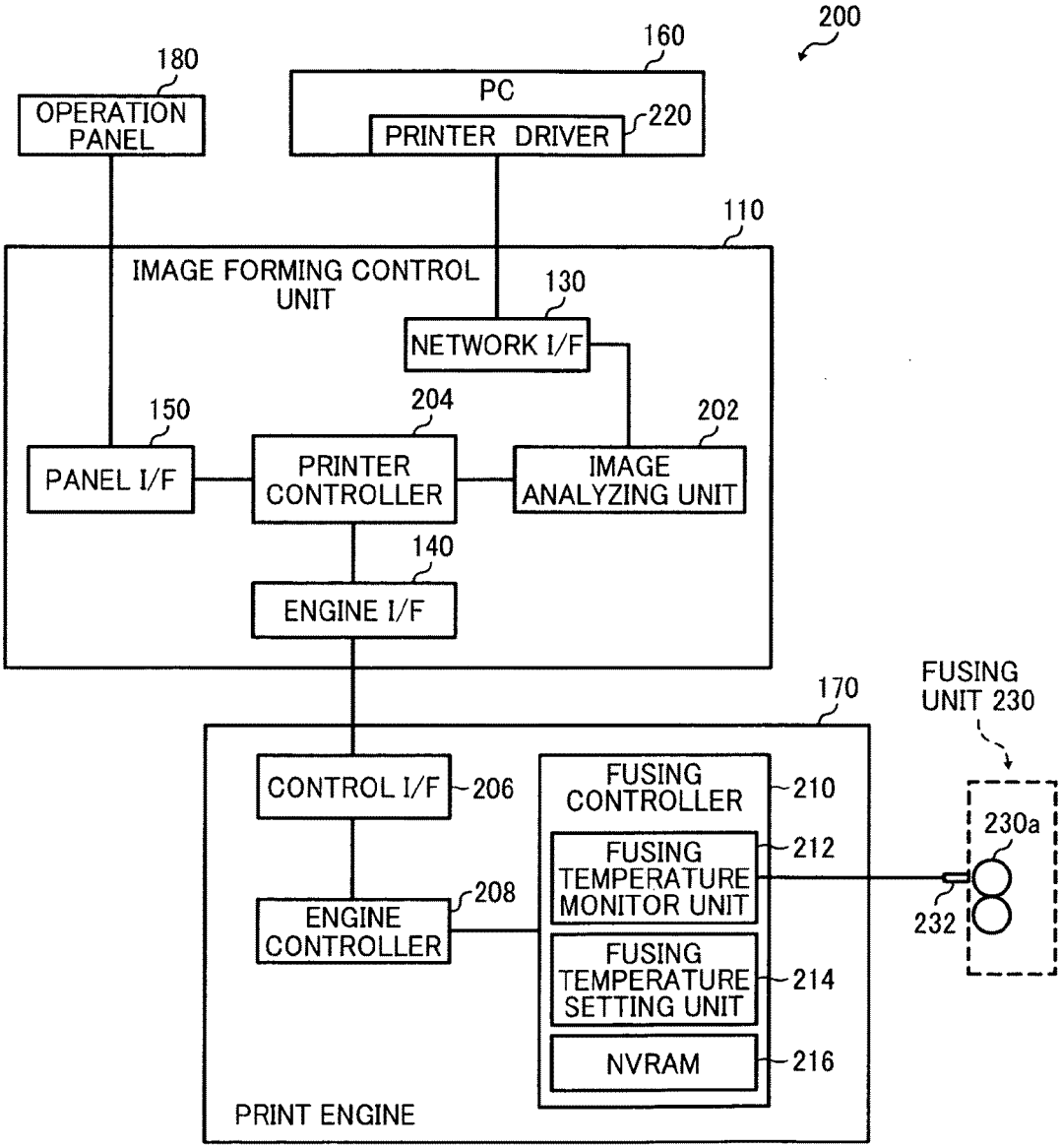
FIG. 2 shows a block diagram of software-implementing functions for the image forming apparatus of FIG. 1.

FIG. 2 shows a block diagram of the image forming apparatus 100, which can be implemented using software according to an example embodiment. Each of functional blocks shown in FIG. 2 may be implemented in the image forming apparatus 100 when the CPU executes programs to function hardware resources in the image forming apparatus 100 as functional units. In the image forming apparatus 100, the image forming control unit 110 may include a printer controller 204, and an image analyzing unit 202. Further, the image forming control unit 110 may include the network I/F 130, the panel I/F 150, and the engine I/F 140, wherein such I/Fs 130, 140, and 150 conduct the above described interface process using given protocols.

Further, as shown in FIG. 2, the PC 160 may include a printer driver 220. In response to an instruction input to the PC 160 such as an user instruction, the printer driver 220 conducts processing such as rasterizing to electronic data to prepare print data, and transmits the prepared print data to the image forming control unit 110.

The printer controller 204 may manage processing by the image forming control unit 110 as a whole such as data acquisition, data transmission, various controls and reporting, and control of the image analyzing unit 202, or the like.

The image analyzing unit 202 analyzes print data, transmitted from the PC 160, interprets page description language (PDL), and transmits the interpreted PDL to the printer controller 204 to prepare page data at the printer controller 204, and the printer controller 204 transmits the page data to the print engine 170. Further, before starting a page processing, the image analyzing unit 202 may obtain a given control information for print data such as for example header area information, the image color information described in PDL, or the like and transmit such control information to the print engine 170 to start a temperature control of fusing unit. Further, when the image color information is not detected in a given data area, the image analyzing unit 202 may transmit the image color information to the print engine 170, for example, as a blank data or information, or may transmit explicit information that the image color information does not exit.

Further, as shown in FIG. 2, the print engine 170 of the image forming apparatus 100 may include a control interface (I/F) 206, an engine controller 208, and a fusing controller 210.

The control I/F 206 receives page data transmitted from the engine I/F 140, and transmits the page data to the engine controller 208. As such, the control I/F 206 includes a given bus interface adaptable with the engine I/F 140.

The engine controller 208 may control an operation of functional units conduct-able by the print engine 170 such as forming a latent image, transferring an image, transporting a medium, and fusing an image, or the like. The engine controller 208, which may include an application specific integrated circuit (ASIC) used for the print engine 170, may implement a fusing control process according to an example embodiment.

Further, upon receiving the image color information from the image forming control unit 110, the engine controller 208 reports the image color information to the fusing controller 210. Upon receiving the image color information from the image forming control unit 110 via the engine controller 208, the fusing controller 210 refers or searches a lookup table (LUT) stored in the NVRAM 118 to obtain a fusing temperature matched to the received image color information. The obtained fusing temperature may be compared with the most recent fusing temperature used for the most recent fusing process. The most recent fusing process is a fusing process that was conducted before the image forming apparatus before the image forming apparatus last shifted to the energy saving mode, which may mean one image forming operation was conducted using the most recent fusing process, then the image forming apparatus shifted to the energy saving mode, and after the energy saving mode continues for some time, another image forming operation is to be conducted, which may be referred to, for example, a sequence of "first image forming operation-> energy saving mode-> second image forming operation." Based on such comparison for the fusing temperature, it is determined whether the fusing temperature for current fusing process needs to be changed. The fusing temperature, set after such fusing temperature determination process, may be set as a target fusing temperature of the fusing controller 210, and such target temperature for fusing process of the fusing controller 210 is used for a temperature control of the fusing unit. Hereinafter, the target temperature for fusing process may be referred to the "target fusing temperature."

Specifically, the fusing controller 210 may include a fusing temperature monitor unit 212, and a fusing temperature setting unit 214. The fusing temperature monitor unit 212 obtains a temperature value of fusing roller 230*a* of the fusing unit 230, detected by a temperature detector 232, and reports the detected temperature value to the fusing temperature setting unit 214. The detected temperature of the fusing roller 230*a*, which may be a current temperature value, is compared with a fusing temperature value set by the fusing temperature setting unit 214. Based on the comparison, an electric current control for the fusing roller 230*a* is conducted.

The fusing temperature setting unit 214 can obtain a fusing temperature matched to a current fusing process based on the image color information received from the engine controller 208. The current fusing process is a to-be-conducted fusing process. A temperature control using the fusing temperature monitor unit 212 can be conducted as such. Further, to conduct such fusing temperature control, the fusing controller 210 may use a NVRAM 216 to store data useable for such temperature control. Further, the NVRAM 118 of the image forming control unit 110 and the NVRAM 216 may be integrated as one memory if such one memory configuration can be devised.

Figure 3:
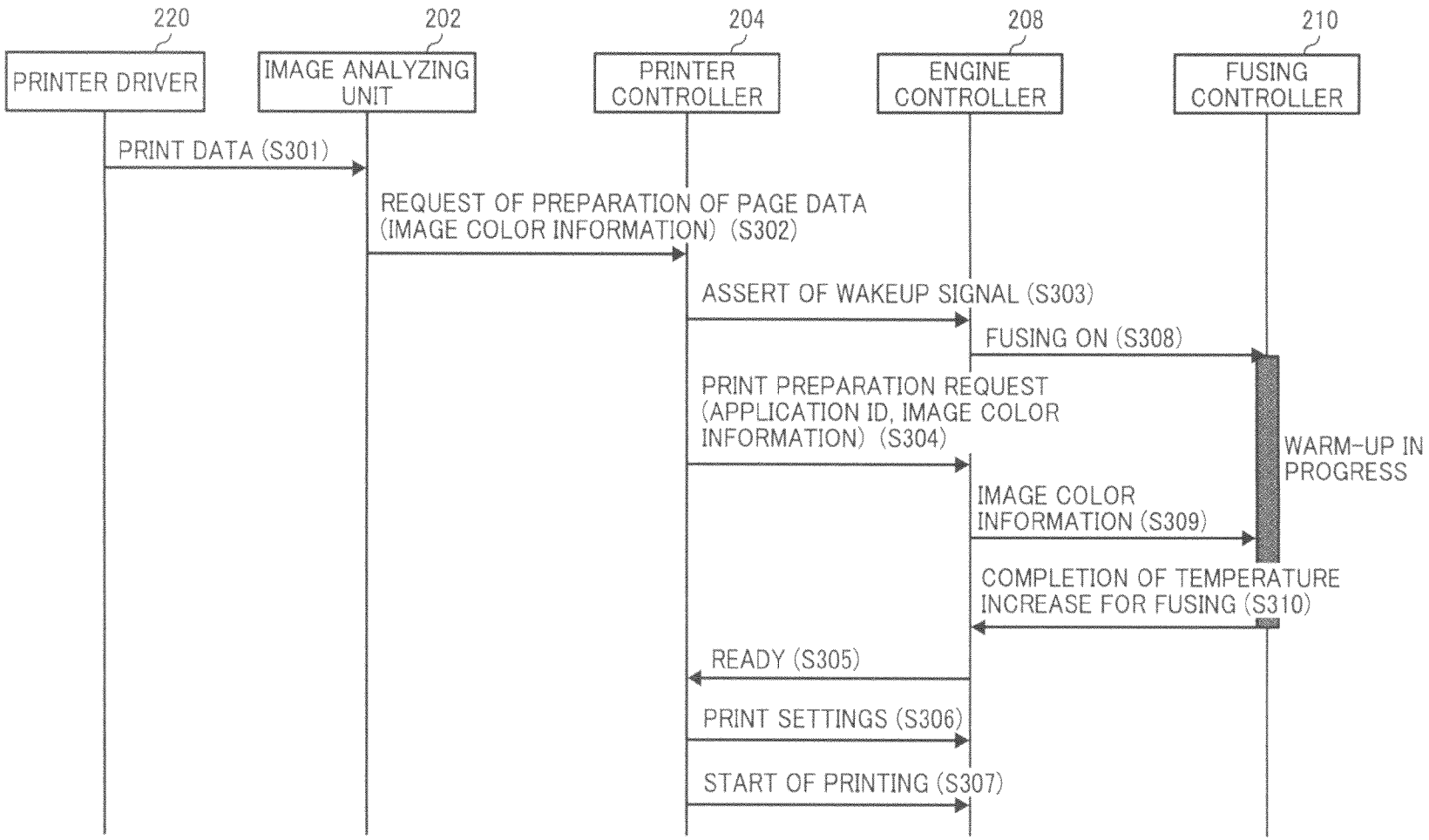
FIG. 3 shows a sequential chart of image forming process by the image forming apparatus of FIG. 1.

FIG. 3 shows a sequential chart of image forming process for the image forming apparatus 100 according to an example embodiment. The process shown in FIG. 3 may proceed in an order of S301, S302, S303, S308, S304, S309, S310, S305, S306, and S307.

As for the image forming process of the image forming apparatus 100, the image analyzing unit 202 of image forming control unit 110 obtains print data transmitted from the printer driver 220 at step S301.

The image analyzing unit 202 transmits the print data and the image color information to the printer controller 204 at step S302 to request the printer controller 204 to prepare a page data.

Upon receiving the preparation request of page data, the printer controller 204 asserts a WakeUp signal, which is a signal to set ON for the fusing unit 230, and reports the WakeUp signal to the engine controller 208 at step S303 before preparing the page data. When the WakeUp signal is asserted and reported, the engine controller 208 reports the fusing ON to the fusing controller 210 at step S308 to start a temperature control sequence for a fusing heater as disclosed in an example embodiment.

Then, the printer controller 204 reports a print preparation request to the engine controller 208 at step S304. The print preparation request may include application identification (ID) information and the image color information, wherein the application ID is an identification value for a print application to be used for printing.

The engine controller 208 reads out a print-execution program module by referring the received application ID, and reports the image color information to the fusing controller 210 at step S309. If the engine controller 208 does not receive an effective value or data for the image color information, the engine controller 208 reports the image color information to the fusing controller 210 as a blank data or information, or a value explicitly indicating that no image color information is included.

By referring the image color information and the fusing temperature used by the most recent fusing process, which was conducted before the image forming apparatus last shifted to the energy saving mode, the fusing controller 210 determines a current fusing temperature, and sets the determined fusing temperature as a target fusing temperature for a current temperature control sequence.

As the temperature control sequence proceeds, the temperature of the fusing roller 230*a* may reach the target fusing temperature. Then, the fusing controller 210 reports a completion of temperature increase process to be used for the fusing process to the engine controller 208 at step S310. Upon receiving the report of completion of temperature increase process, the engine controller 208 reports a Ready signal, which indicates the fusing unit 230 is ready for the fusing process, to the printer controller 204 at step S305, and the engine controller 208 simultaneously transmits a transmission request of the page data to the printer controller 204.

Upon receiving the Ready signal, the printer controller 204 starts to prepare the page data and reports print settings such as for example a designation of sheet feed tray, a type of sheet, a print sheet size or the like to the engine controller 208 at step S306. The designation of sheet feed tray, type of sheet, print sheet size or the like may be included in data area of print attribution in the print data received at step S301. In an example embodiment, the print attribution may be information, which may have an effect to a fusing temperature, such as for example color mode for printing (e.g., full color printing mode, monochrome printing mode), types of sheet, sheet thickness or the like to be used when conducting a printing, which may be used alone or in combination.

Then, the printer controller 204 reports a start of printing to the engine controller 208 at step S307, and transmits the prepared page data to the engine controller 208 sequentially, and the engine controller 208 executes the page printing, and after fusing the toner (i.e., development agent) by the fusing unit, a printed product matched to the electronic data can be output.

Figure 4:
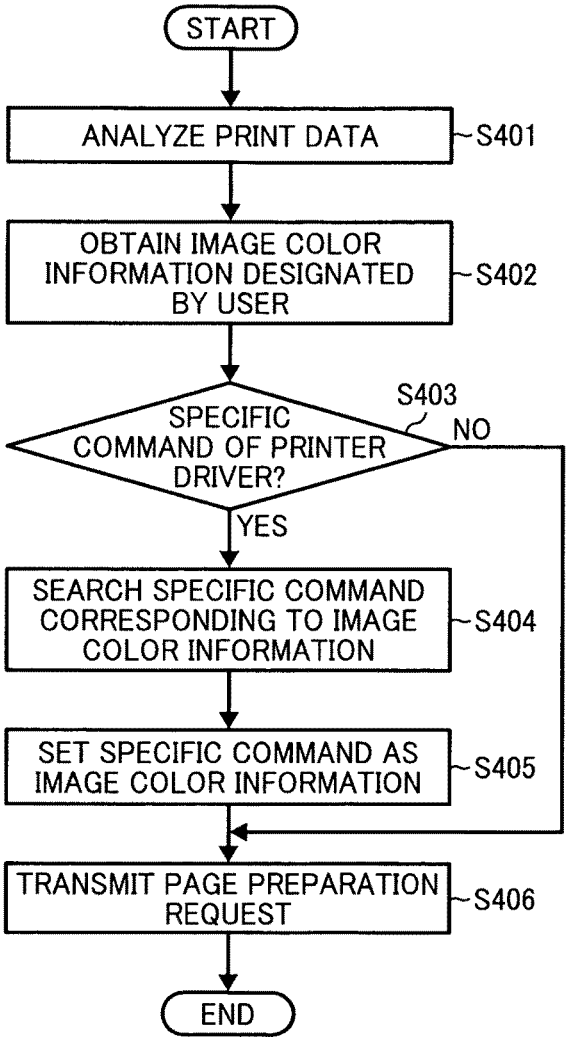
FIG. 4 shows a flowchart of processing by an image analyzing unit according to an example embodiment.

FIG. 4 shows a flowchart of processing conduct-able by the image analyzing unit 202 according to an example embodiment. The processing of the image analyzing unit 202 starts at step S400. The image analyzing unit 202 analyzes a print data at step S401. In the processing according to an example embodiment, the analysis by the image analyzing unit 202 may include a determination of the version of page description language (PDL), a determination whether specific page description language (PDL) exists or not, and a determination whether the image color information exists or not. As such, the PDL is analyzed in the analysis process at step S401.

At step S402, the image color information designated by a user is obtained. At step S403, it is determined whether a specific command for the printer driver corresponding to the used PDL version or the like exists by referring a lookup table (LUT) or a driver resource list or the like, in which a specific command may be corresponded to the image color information. The driver resource list can be registered as a firmware such as management data in, for example, the ROM 114 before shipment of apparatus.

Then, if it is determined that the specific command is not registered at step S403 (No), the process goes to step S406. In contrast, when it is determined that the specific command is registered at step S403 (Yes), the engine controller 208 is required to be controlled using the specific command.

At step S404, the specific command corresponding to the image color information is searched from a lookup table (LUT) or the like. At step S405, the specific command is set as the image color information. Then, a page preparation request is transmitted to the printer controller 204 at step S406. Then, the image analyzing unit 202 ends its processing and the subsequent processing may be started.

Figure 5:
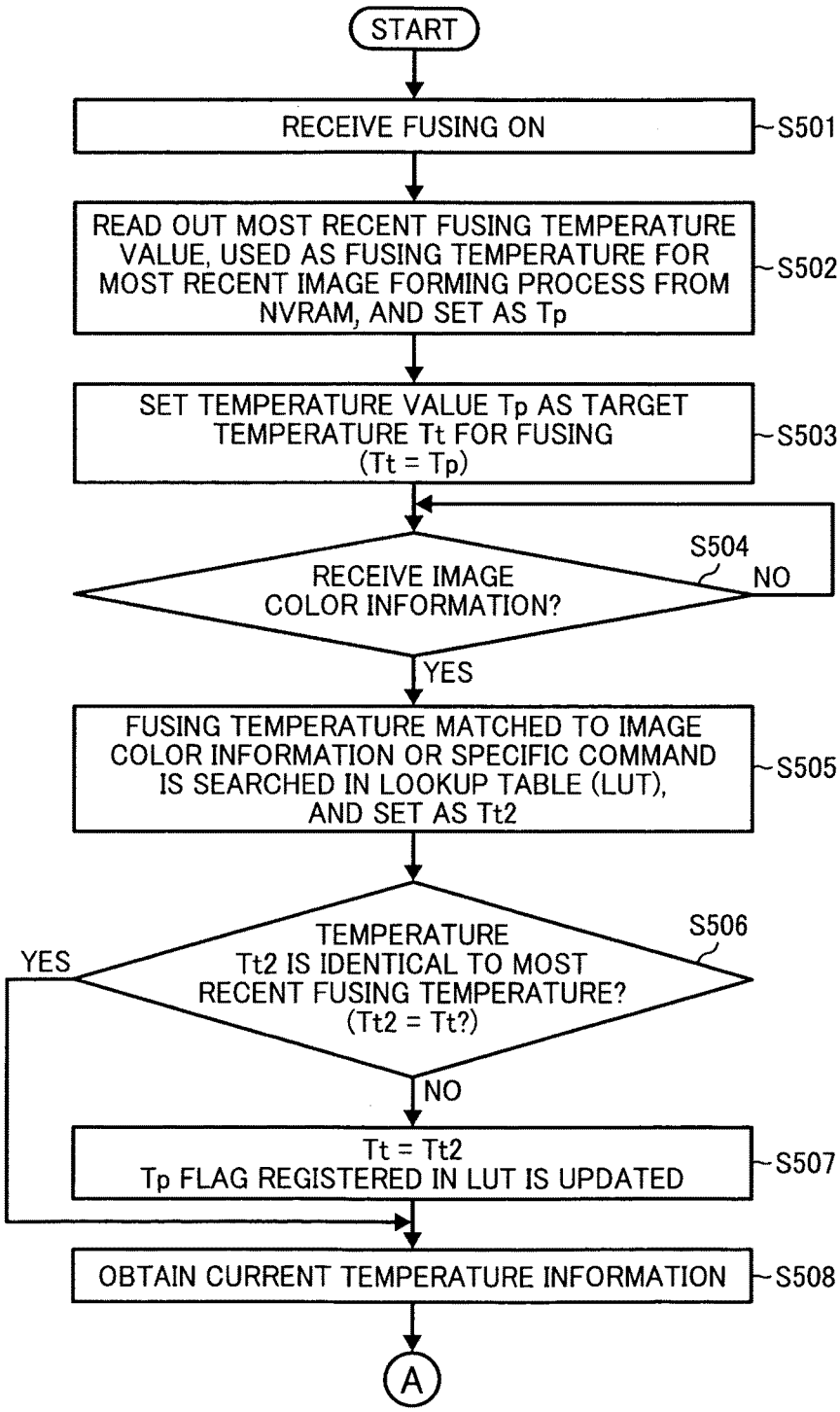
FIG. 5 and FIG. 6 show a flowchart of processing by a fusing controller according to an example embodiment.
Figure 6:
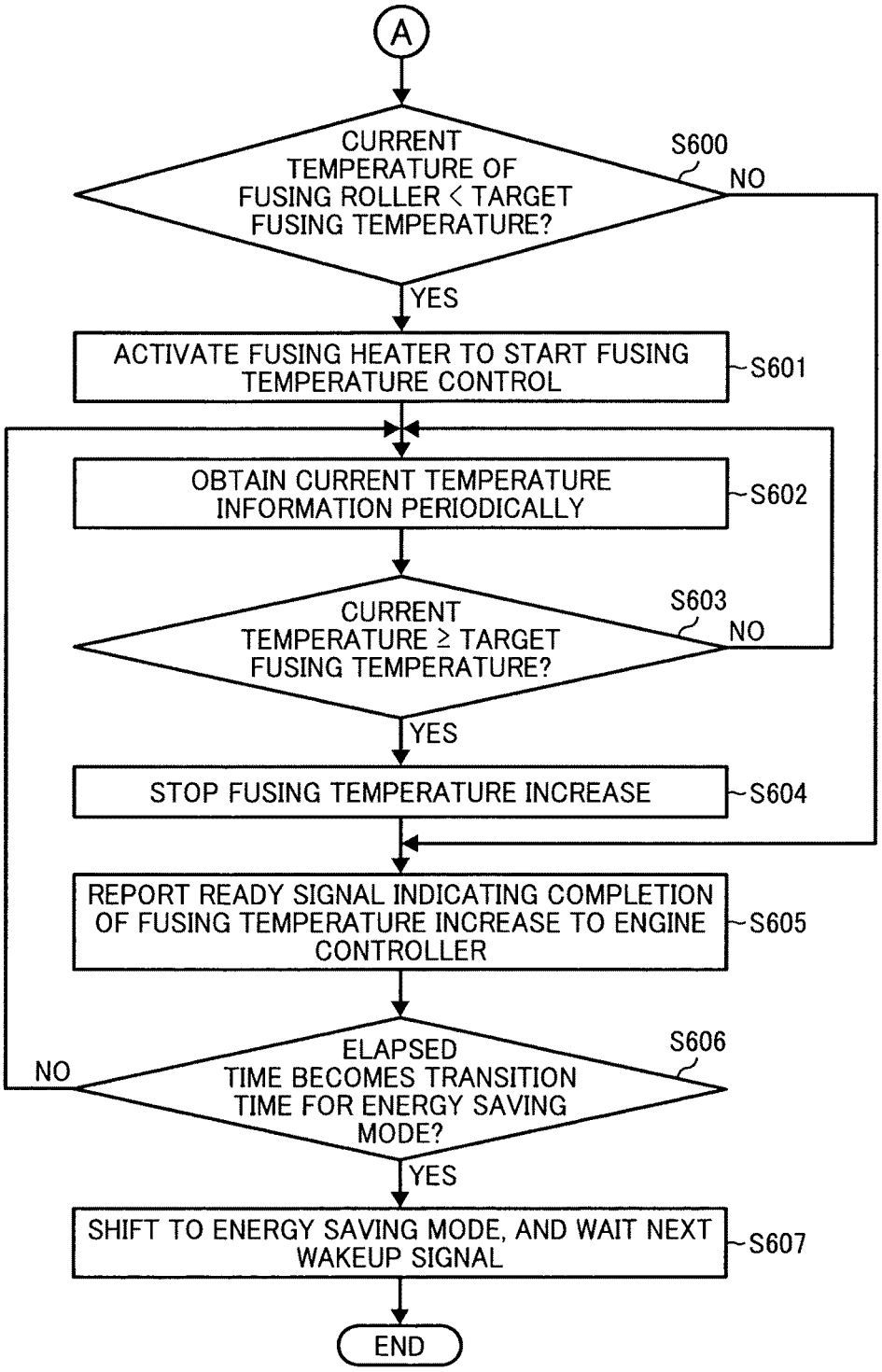

A description is given of processing conduct-able by the fusing controller 210 according to an example embodiment with reference to FIGS. 5 and 6, which show a flowchart of processing conduct-able by the fusing controller 210. The processing by fusing controller 210 may start at step S500 (FIG. 5). At step S500, the fusing controller 210 may be in a waiting mode, which can receive a fusing ON signal. When the fusing ON is received at step S501, the fusing controller 210 starts processing to set a target fusing temperature to be used for a currently requested image forming operation.

At step S502, the fusing controller 210 reads out the most recent fusing temperature value, used as the fusing temperature for the most recent image forming process, from a memory such as a NVRAM.

At step S503, such temperature value read by the fusing controller 210 is set in a memory (e.g., register memory) as a temperature Tp, and the temperature Tp is temporary set as a target fusing temperature Tt (set Tt=Tp). The target fusing temperature Tt is a control value useable by the fusing controller 210 to set a fusing temperature of the fusing unit 230. The fusing controller 210 conducts an electric current control for a fusing heater so that the temperature of the fusing roller 230*a* can be set to the target fusing temperature Tt or so.

At step S504, it is determined whether the image color information is received. If the image color information is not received (step S504: No), the fusing controller 210 may wait to receive the image color information. On one hand, if the image color information is received (step S504: Yes), at step S505, a fusing temperature matched to the image color information or specific command is searched in a lookup table (LUT), and set as temperature Tt2. The receiving of image color information may mean that the engine controller 208 is explicitly reported with the effective value or data for the image color information at step S309 in FIG. 3.

At step S506, it is determined whether the temperature Tt2 designated by the currently transmitted image color information or specific command is matched or identical to the temperature Tt (=Tp), which is the most recent fusing temperature.

If the temperature Tt2 is matched or identical to the most recent fusing temperature (S506: Yes) (i.e., not different from the most recent fusing temperature), the process goes to step S508 using the setting of Tt=Tp, set at step S503. On one hand, if it is determined that the temperature Tt2 is not matched or identical to the most recent fusing temperature at step S506 (S506: No) (i.e., different from the most recent fusing temperature), the fusing temperature is set as Tt=Tt2 at step S507, and the fusing temperature different from the most recent fusing process is set, and further, a Tp flag registered in a table is updated at step S507.

At step S508, such temperature Tt determined by conducting the previous steps is set as a current target fusing temperature, by which the current temperature information for the fusing roller 230*a* is obtained.

The current fusing process may be conducted using any one of following two temperature settings: (1) fusing process using the fusing temperature used at the most recent fusing process; and (2) fusing process using the fusing temperature, different and lower temperature compared to the fusing temperature used at the most recent fusing process.

The most recent fusing process means a fusing process that was conducted before the image forming apparatus last shifted to the energy saving mode, in which the mode was shifted and maintained at such energy saving mode for a given time before the current print job is started. For example, the energy saving mode may be set between two print jobs such as first and second print jobs, in which after the fusing process for the first print job is conducted, the energy saving mode may be set for the image forming apparatus. Then, after the energy saving mode is maintained for a given time period, the second print job is started. After step S508 in FIG. 5, the process goes to the point A shown in FIG. 6.

The process shown in FIG. 6 continues from the process shown in FIG. 5. At step S600, it is determined whether the temperature of the fusing roller 230*a*, currently detected by the temperature detector 232, is lower than the target fusing temperature. If the current temperature of the fusing roller 230*a* is lower than the target fusing temperature (S600: Yes), a fusing heater is activated to start a temperature control for the fusing roller 230*a* at step S601. On one hand, if the temperature of the fusing roller 230*a*, currently detected by the temperature detector 232, is not lower than the target fusing temperature (S600: No), the process goes to step S605, and subsequent process is conducted.

Further, at step S602, the current temperature information of the fusing roller 230*a* is obtained periodically. At step S603, it is determined whether the current temperature of the fusing roller 230*a* is at the target fusing temperature or more.

If it is determined that the current temperature of the fusing roller 230*a* is at the target fusing temperature or more (S603: Yes) based on the determination result at step S603, the fusing temperature increase process is stopped at step S604, and the temperature of the fusing roller 230*a* is maintained at the fusing temperature or so. On one hand, if it is determined that the current temperature of the fusing roller 230*a* is below the target fusing temperature (S603: No) based on the determination result at step S603, the process goes back to step S602, and the fusing temperature increase process is continued until the determination result at step S603 indicates that current temperature of the fusing roller 230*a* is at the target fusing temperature or more.

At step S605, the Ready signal indicating a completion of fusing temperature increase is reported to the engine controller 208, and then a transmission of page data is requested.

At step S606, the elapsed time duration from the most-recently-processed page data is monitored to determine whether the elapsed time duration becomes a transition time to shift to the energy saving mode. If the elapsed time duration becomes the transition time to shift to the energy saving mode (S606: Yes), the image forming apparatus transits or shifts to the energy saving mode at step S607, and waits an assertion of next WakeUp signal, and ends processing by the fusing controller 210. Further, if the elapsed time duration does not yet become the transition time to shift to the energy saving mode (step S606: No), the process goes back to step S602, and page data transmission from the engine controller 208 and subsequent process may be repeated.

FIG. 7 shows example lookup tables (LUT) stored in the NVRAM 118 and/or NVMRAM 216 and useable by the image analyzing unit 202 and the fusing controller 210. The LUTs 700 and 710 may be registered, for example, in the NVRAM 216, wherein the fusing controller 210 may control or manage the LUTs 700 and 710 directly. The LUTs 700 and 710 may register and manage information such as image color information, target fusing temperature corresponding to the image color information, and Tp flag, wherein such information may be useable by the fusing controller 210.

A description is given of the LUT 700. The LUT 700 has a column 702 registered with the image color information. For example, the registered image color information may be color information, and monochrome information. For example, when the image color information is color information, the full color printing may be designated, and when the image color information is monochrome information, the monochrome printing is designated using one color toner such as white and black printing using black toner. The color printing may be conducted by using a plurality of colors, in which at least two or more colors (e.g., color agents) are used, and the monochrome printing is conducted by using one color. As such, "color" in the column 702 may mean at least two or more colors are used for image forming. In some case all of the colors available for the image forming apparatus may be used for printing which may be referred to as full color printing, and in some case, not all but some of colors available for the image forming apparatus may be used for printing.

The column 704 may be registered with a fusing temperature value for the fusing roller 230*a*, corresponding to each of the image color information as indicated by "Tc" and "Tm" respectively set for "color" printing and "monochrome" printing. Accordingly, by referring the image color information of the LUT 700, the fusing temperature of fusing unit 230 can be variably changed. It should be noted that the LUT 700 is just one example LUT, and other LUT can be set. For example, the fusing temperature may be registered in a LUT along with information of types of sheet, in which the fusing temperature may be variably changed depending on the image color information and the types of sheet information as shown in the LUT 710.

The LUT 710 may be registered with suitable fusing temperature in view of the image color information and the types of sheet information. The LUT 710 includes a column 712 and a column 714 as shown in FIG. 7. The image color information is registered in the column 712, and the corresponding fusing temperature is registered in the column 714 for each of different types of sheet. Further, the LUT 710 is corresponded with the Tp flag table 720. Specifically, each one of data in the matrix of LUT 710 may be corresponded to each one of data in the matrix of Tp flag table 720. When a data in the matrix of LUT 710 having one fusing temperature value is designated, the corresponding Tp flag in the Tp flag table 720 is checked to determine whether the temperature to be used for the current fusing process matches or un-matches the most recent fusing process.

The combination patterns of fusing temperature and sheet type can be exhaustively registered in the LUT 710 by considering possible combination patterns as much as possible. If the LUT 710 is registered with such exhaustively prepared information, the fusing temperature control can be conducted flexibly by only changing data structure of the NVRAM 216 while not changing the process flow of FIGS. 4, 5, and 6 so much. Further, if the image forming control unit 110 and the print engine 170 can share the NVRAM 118, the LUTs 700 and 710 can be registered in the NVRAM 118 with the to-be-described LUT 730. Such setting can be set in view of specific requirements, as required.

Further, the column 706 of LUT 700 or the Tp flag table 720 are data area for registering Tp flag, in which the most recent fusing temperature or currently valid fusing temperature is registered with a value of "1," and the fusing temperature, which is not currently valid, is registered with a value of "0," and such Tp flag is used as toggle flag. In an example embodiment, when the target fusing temperature value is to be prepared for the numbers of "N" (first, second, third values, and so on), the value of "toggle flag" for (i)-th fusing temperature satisfies the following formula (I) as Value_of_Flag(i) except for a time when to set flag.

$$\sum_{i=1}^{N} \text{Value_of_Flag}(i) = 1 \qquad \text{formula (1)}$$

Based on the formula (1), the flag information in the Tp flag table may be changed, in which when a new fusing temperature is set, the Tp flag for the previously used fusing temperature is reset to 0, and the Tp flag for the new target fusing temperature is set to 1. In the example tables shown in FIG. 7, two target temperatures may be set, but the number of target fusing temperatures that can be set is not limited thereto as indicated by the above formula (1).

The Tp flag, set by the above formula (1), can be used as run time data to designate a temperature condition for the current fusing process, and can be also registered in the NVRAM 118. Such registered value can be used as the initial or default value of the target fusing temperature when the image forming apparatus returns from the energy saving mode again. Such feature may be useful for a user using a color image forming apparatus for outputting monochrome images most of the time. When the user uses the color image forming apparatus to output the monochrome image most of the time, the fusing temperature used for monochrome printing can be registered or stored in the NVRAM 118 with such a configuration. Therefore, even if the user forget to set the image color information of monochrome printing, the electric power used for the fusing process may not be consumed too much, and thereby the image forming apparatus 100 can be operated without consuming too much electric power, which means energy can be used efficiently and energy saving can be attained. In an example embodiment, the image forming apparatus 100 can be operated with a higher fusing temperature only when such higher fusing temperature is required based on a specific demand on image forming operation. Accordingly, the energy saving can be achieved effectively for the color image forming apparatus, which can form images using a plurality of colors.

The LUT 730 shown in FIG. 7 may be used when the printer driver 220 designates the image color information using a specific command. Based on the searched specific command, the image analyzing unit 202 obtains a fusing temperature when the corresponding specific command is reported for the image color information. For example, in a column 732 of LUT 730, printer control commands such as high_fix_temp and low_fix_temp are set, and the fusing temperature of color printing is registered in the column 734 as temperature Tc, and the fusing temperature for monochrome printing is registered in the column 734 as temperature Tm. The LUT 730 may not have column for the Tp flag, but the LUT 730 and LUT 700 can be used together to search a fusing temperature and a corresponding Tp flag. Specifically, a fusing temperature is searched and obtained using the LUT 730, and then it Can be determined whether the searched and obtained fusing temperature is the most recent fusing temperature value or not by referring the LUT 700. Further, as similar to the LUT 700, the Tp flag column can be added to the LUT 730 as the toggle flag.

In the above described configuration shown in FIGS. 6 and 7, the image forming operation by using a color image forming apparatus can be conducted in an energy-efficient manner at least for the fusing process, in which the fusing temperature can be controlled at a suitable level for image forming condition by determining the color mode for printing before conducting the image forming operation. Specifically, a monochrome printing can be conducted without using a too-high fusing temperature, which may be used by the conventional art whenever the conventional art conducts image forming operation for any types of color mode for printing. In an example embodiment, specifically, the printer driver may be provided with a function to analyze the print data to determine whether the color mode corresponding to the specific command is set. If the printer driver determines that the color mode corresponding to the specific command exists, the image forming may be conducted in view of such determined color mode. Further, data, specific command, or the like required for such fusing temperature control can be stored in a memory such as NVRAM or the like, provided for the image forming apparatus according to an example embodiment.

Figure 8:
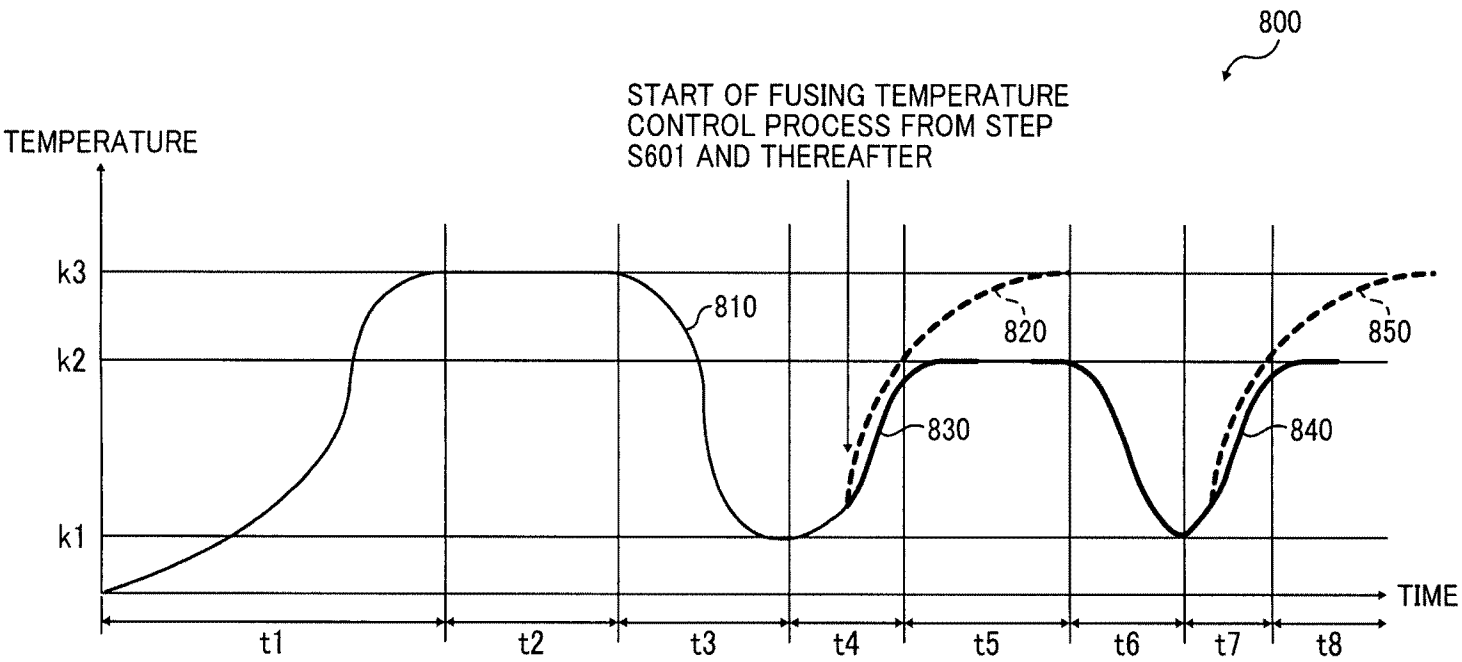
FIG. 8 shows an example temperature profile of fusing temperature in line of a print sequence according to an example embodiment.

FIG. 8 shows an example temperature profile of fusing temperature in view of print sequence according to an example embodiment, in which the horizontal axis indicates a time line along a print sequence, and the vertical axis indicates the temperature of fusing roller 230*a*.

The temperature k1 may indicate a temperature at the energy saving mode, the temperature k2 may indicate a fusing temperature required for monochrome printing using only one toner such as black toner, and the temperature k3 may indicate a fusing temperature required for full color printing using a plurality of color toners such as for example four color toners. When the full color printing is conducted, toner particles need to be melted sufficiently for enhancing color mixing performance and gloss performance, and thereby a fusing temperature for full color printing needs to be set higher than a fusing temperature for monochrome printing. It should be noted that the temperatures k1, k2, and k3 can be set to given values in view of conditions related to image forming.

In FIG. 8, the period t1 indicates a period from the power source is set to ON and until the print mode is set, and the period t2 indicates a period during the print mode, wherein printing operation is activated in the print mode.

In the conventional art, a fusing unit may be heated to a fusing temperature such as the temperature k3, which can be used for any types of printing such as monochrome and color printing. When the image forming apparatus 100 ends printing, and a given time period elapses, the image forming apparatus 100 shifts to the energy saving mode, and the electric power consumption level is set to a minimum level such as maintaining the minimum function of CPU, and thereby the electric current control for the fusing roller 230*a* is stopped, and temperature shifts from the print mode to the energy saving mode during the period t3 along the temperature profile 810 (see FIG. 8) in case of the conventional art.

In contrast, when a user designates the image color information in an example embodiment, the image forming apparatus 100 sets a fusing temperature required for the image color information as the target fusing temperature, and conducts a temperature control of the fusing roller 230*a*.

In FIG. 8, the period t4 indicates a period from the energy saving mode until the monochrome printing mode is set when the user designates the monochrome printing. In the period t4, the user designates the monochrome printing, by which the temperature of fusing roller 230*a* may be increased to a fusing temperature for monochrome printing along the temperature profile 830, which is lower than the temperature profile 820 of the fusing roller 230*a* used for the conventional art configuration. With such temperature control in an example embodiment, the temperature of fusing roller 230*a* can be set at a lower level, and a start timing of printing can be shortened, and resultantly, the energy saving can be achieved and an early wakeup of apparatus can be achieved.

Further, in an example embodiment, the fusing temperature value used in the period t4 as run time data can be registered in the NVRAM 118 as control data. Therefore, when the image forming apparatus 100 transits or shifts from the energy saving mode to the printing mode in the period t7, the fusing temperature for monochrome printing can be set again along the temperature profile 840 (see FIG. 8) unless a user sets a color printing mode intentionally (see temperature profile 850 for color printing). Therefore, even the user does not set the image color information for each time the image forming operations are conducted, the energy saving and/or an early wakeup of the image forming apparatus 100 can be achieved, and an image forming operation can be conducted efficiently by the image forming apparatus 100.

Figure 9:
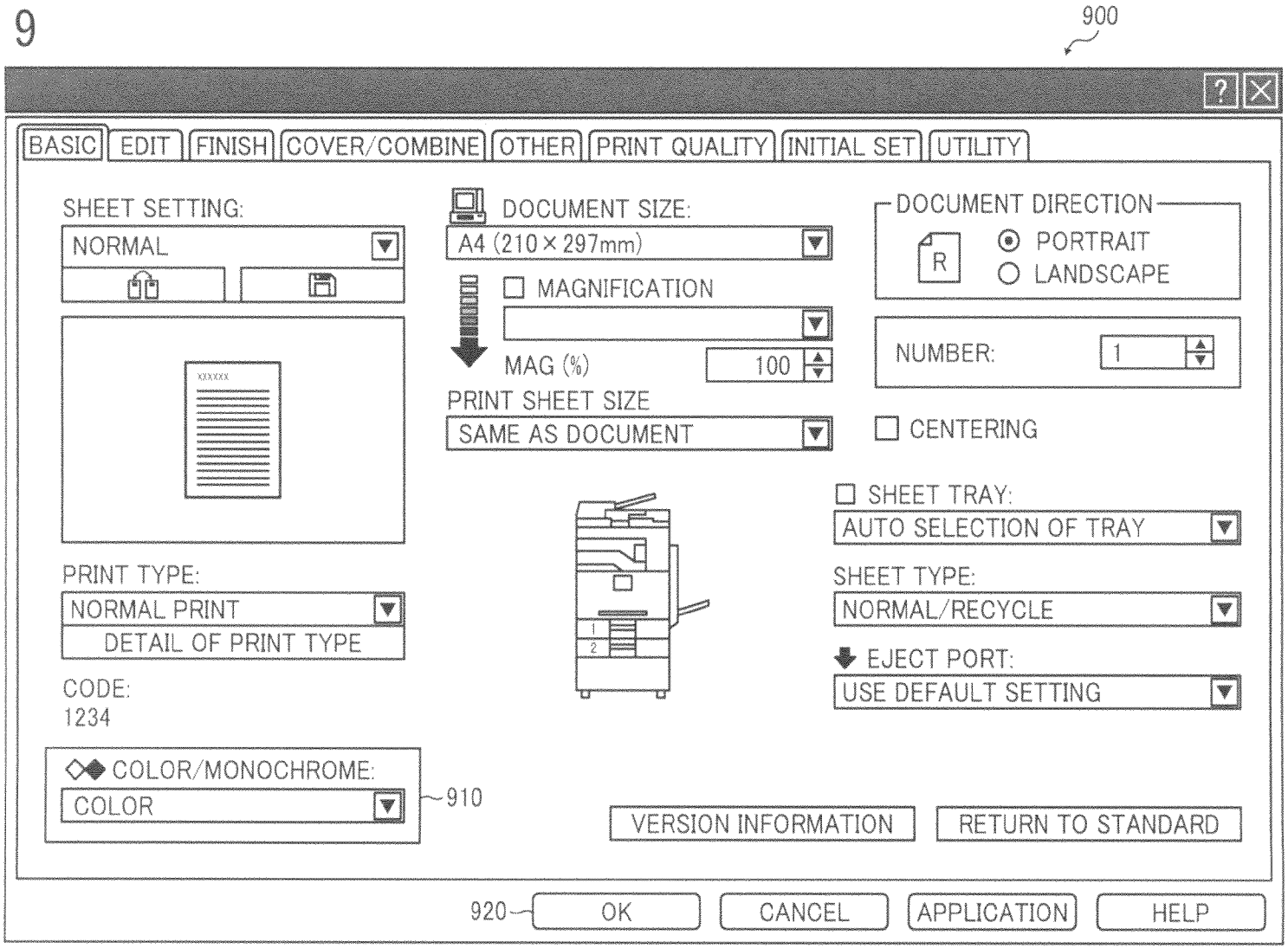
FIG. 9 shows an example of graphical user interface (GUI) displayable on a screen by a printer driver according to an example embodiment.

FIG. 9 shows an example graphical user interface (GUI) 900, which can be displayed on a screen of the PC 160 by the printer driver 220. For example, the GUI 900 may be displayed on a desktop screen of the PC 160. The GUI 900 may include input buttons and/or fields for inputting various print settings, and graphic display windows for displaying images such as print image. Specifically, the GUI 900 may include an input field 910 for setting the image color information using a pull-down list. A user can set the image color information using the input field 910, and then by clicking a button icon 920, a printing operation using the designated image color information can be instructed.

Further, the information set in the input field 910 can be maintained as a default setting once the information is set, and thereby the most-recently set information can be displayed on the GUI 900 when the GUI 900 is called again. Accordingly, for example, once the monochrome printing is set in the input field 910, the amount of power consumption for fusing process can be set to a level for the monochrome printing as long as the color printing is not selected. When a user changes the information in the input field 910 by requesting the color printing, the amount of power consumption for fusing process may be increased compared to the monochrome printing. With such a configuration, the amount of power consumption for fusing process can be effectively adjusted with an energy-efficient manner such as reducing the amount of power consumption, or increasing the amount of power consumption, as required.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. Further, in the above-described exemplary embodiment, a storage device (or recording medium), which can store computer-readable program, may be a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, hard disk in a server, or the like, but not limited these. Further, a computer-readable program can be downloaded to a particular computer (e.g., personal computer) via a network such as the internet, or a computer-readable program can be installed to a particular computer from the above-mentioned storage device, by which the particular computer may be used for the system or apparatus according to an example embodiment, for example.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus for receiving print data from an information processing apparatus and outputting the print data as a printed product on a recording medium, the image forming apparatus comprising:

a fusing unit;

an image forming control unit to receive the print data and corresponding print attribution information to prepare page data for printing the printed product, with the image forming apparatus shifted from an energy saving mode to a print mode; and a print engine that includes a fusing controller having a fusing temperature setting unit to control a fusing temperature of the fusing unit, the print engine obtaining the page data and the corresponding print attribution information from the image forming control unit, the print engine outputting the printed product using a fusing temperature designated by the print attribution information, wherein, when the image forming apparatus returns from the energy saving mode to the print mode, the fusing controller determines a target fusing temperature for the fusing unit by comparing a first fusing temperature and a second fusing temperature, the first fusing temperature being used for a most recent fusing process conducted before the image forming apparatus last shifted to the energy saving mode, the second fusing temperature being designated by the print attribution information, the fusing controller determines the target fusing temperature using the first fusing temperature or the second fusing temperature depending on the number of colors required for printing the printed product.

2. The image forming apparatus of claim 1, wherein when the first fusing temperature used for the most recent fusing process is matched to the second fusing temperature designated by the print attribution information corresponding to current print data for an image forming operation, the fusing controller causes the fusing unit to output the printed product using the first fusing temperature.

3. The image forming apparatus of claim 2, wherein during a time period extending from receipt of an instruction to activate the fusing to actual setting of a target fusing temperature for the fusing unit, the fusing controller compares the first fusing temperature used for the most recent fusing process and the second fusing temperature designated by the print attribution information corresponding to current print data for the image forming operation to determine which one of the first fusing temperature and the second fusing temperature is to be set as the target fusing temperature for the fusing unit.

4. The image forming apparatus of claim 1, wherein the print attribution information is any one of the number of colors to be used for printing, types of print sheet, and a combination of the number of colors and the types of print sheet.

5. The image forming apparatus of claim 4, wherein when the image forming apparatus outputs the printed product using a fusing temperature different from the first fusing temperature used for the most recent fusing process, the image forming apparatus updates and stores the fusing temperature different from the first fusing temperature used for the most recent fusing process as a default fusing temperature before the image forming apparatus returns to the energy saving mode after the output of the printed product.

6. The image forming apparatus of claim 4, wherein the image forming control unit includes an image analyzing unit to determine the number of colors to be used for printing, and the fusing temperature setting unit determines at least the number of colors to be used for printing included in the print attribution information to control setting of a fusing temperature for the fusing unit.

7. The image forming apparatus of claim 6, wherein, the setting of the fusing temperature for the fusing unit is varied depending on the number of colors to be used for printing as determined by the image analyzer.

8. An image forming method for outputting print data, received from an information processing apparatus, as a printed product on a recording medium using a fusing unit of an image forming apparatus, the method comprising the steps of:

receiving the print data and corresponding print attribution information to prepare page data for printing the printed product;

comparing a first fusing temperature and a second fusing temperature, the first fusing temperature being used for a most recent fusing process conducted before the image forming apparatus last shifted to the energy saving mode, the second fusing temperature being designated by the print attribution information;

determining a target fusing temperature of the fusing unit based on a result of the comparing step, in which, when the image forming apparatus returns from the energy saving mode to the print mode, the target fusing temperature being determined using the first fusing temperature or the second fusing temperature depending on the number of colors required for printing the printed product; and fusing the printed product using the target fusing temperature set at the controlling step.

9. The method of claim 8, wherein the determining step is conducted after receiving an instruction to activate the fusing unit and until a temperature of the fusing unit is increased to the target fusing temperature.

10. A computer-readable medium storing a program comprising instructions that when executed by a computer cause the computer to execute an image forming method for outputting print data, received from an information processing apparatus, as a printed product on a recording medium using a fusing unit of an image forming apparatus by executing a program with the computer, the method comprising the steps of:

receiving the print data and corresponding print attribution information to prepare page data for printing the printed product;

comparing a first fusing temperature and a second fusing temperature, the first fusing temperature being used for a most recent fusing process conducted before the image forming apparatus last shifted to the energy saving mode, the second fusing temperature being designated by the print attribution information;

determining a target fusing temperature of the fusing unit based on a result of the comparing step, in which, when the image forming apparatus returns from the energy saving mode to the print mode, the target fusing temperature being determined using the first fusing temperature or the second fusing temperature depending on the number of colors required for printing the printed product; and fusing the printed product using the target fusing temperature set at the controlling step.

* * * * *